US011213077B2

(12) United States Patent
Stephens et al.

(10) Patent No.: US 11,213,077 B2
(45) Date of Patent: Jan. 4, 2022

(54) CORSET HOLSTER

(71) Applicant: Tedder Industries, LLC, Post Falls, ID (US)

(72) Inventors: Drew Stephens, Coeur d'Alene, ID (US); Jacob Shearer, Post Falls, ID (US)

( * ) Notice: Subject to any disclaimer, the term of this patent is extended or adjusted under 35 U.S.C. 154(b) by 64 days.

(21) Appl. No.: 16/784,728

(22) Filed: Feb. 7, 2020

(65) Prior Publication Data

US 2020/0253290 A1 Aug. 13, 2020

Related U.S. Application Data

(60) Provisional application No. 62/803,785, filed on Feb. 11, 2019.

(51) Int. Cl.
*A41C 1/00* (2006.01)
*F41C 33/04* (2006.01)

(52) U.S. Cl.
CPC ..... *A41C 1/00* (2013.01); *F41C 33/048* (2013.01)

(58) Field of Classification Search
CPC ..... A45F 2003/144; A45F 2003/148; F41C 33/048; F41C 33/00; F41C 33/02; F41C 33/0209; F41C 33/0218; F41C 33/0236; A41C 1/00
USPC ..... 450/150, 89
See application file for complete search history.

(56) References Cited

U.S. PATENT DOCUMENTS 4,579,265 A * 4/1986 Schiller ..... A45C 1/04 224/222
2011/0220698 A1* 9/2011 Tuggle ..... F41C 33/048 224/587
2011/0226825 A1* 9/2011 Sanford ..... F41C 33/0218 224/243
2015/0102078 A1* 4/2015 Scutte ..... A41C 1/00 224/576
2015/0122861 A1* 5/2015 Adams ..... F41C 33/0218 224/587
2015/0233670 A1* 8/2015 Galoob ..... F41C 33/046 224/587
2015/0366280 A1* 12/2015 Fay ..... F41C 33/046 2/311

* cited by examiner

*Primary Examiner* — Gloria M Hale

(57) ABSTRACT

Representative implementations of devices and techniques provide a corset holster comprising a garment having one or more holsters, holster pockets, and/or the like (such as for carrying a handgun, for example), integral to or coupled to the garment. The corset holster allows a user to conveniently carry one or more implements and/or implement accessories in various carry options, including in a concealed manner. For example, the garment may be worn on the user beneath a layer of clothing, if desired.

20 Claims, 5 Drawing Sheets

FRONT VIEW

PORTION OR PANEL (ALT 2)

FRONT VIEW

FRONT VIEW

FRONT VIEW

BACK VIEW

CORSET HOLSTER

PRIORITY CLAIM AND CROSS-REFERENCE TO RELATED APPLICATION

This application claims the benefit under 35 U.S.C. § 119(e)(1) of U.S. Provisional Application No. 62/803,785, filed Feb. 11, 2019, which is hereby incorporated by reference in its entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished. In some cases, such as with a handgun for example, the holster may allow the user to conceal the implement, or to conceal the fact that the user is carrying the implement.

In the case of a handgun, the holster should reasonably protect the handgun and the user, and should be convenient to the user for ready use. Accordingly, the holster should retain the handgun until it is to be used, but allow the user to draw the handgun for use without undue effort or difficulty. The holster should be rigid and stable enough to allow the handgun to be repeatedly drawn and re-holstered, usually with the same hand. However, the holster should also be versatile enough to be comfortably carried by the user, such as when it is worn on the person of the user for an extended length of time.

At times it can be desirable to carry an implement such as a handgun in various locations on the user, for instance in a concealed location underneath a layer of the user's clothing. However, when doing so, it is desirable that the holster provides versatility, as well as a high level of protection to the user and also to the handgun. For example, a holster that provides adequate protection but does not allow for a user to effectively conceal the holster or the handgun may not be acceptable.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Figure 1:
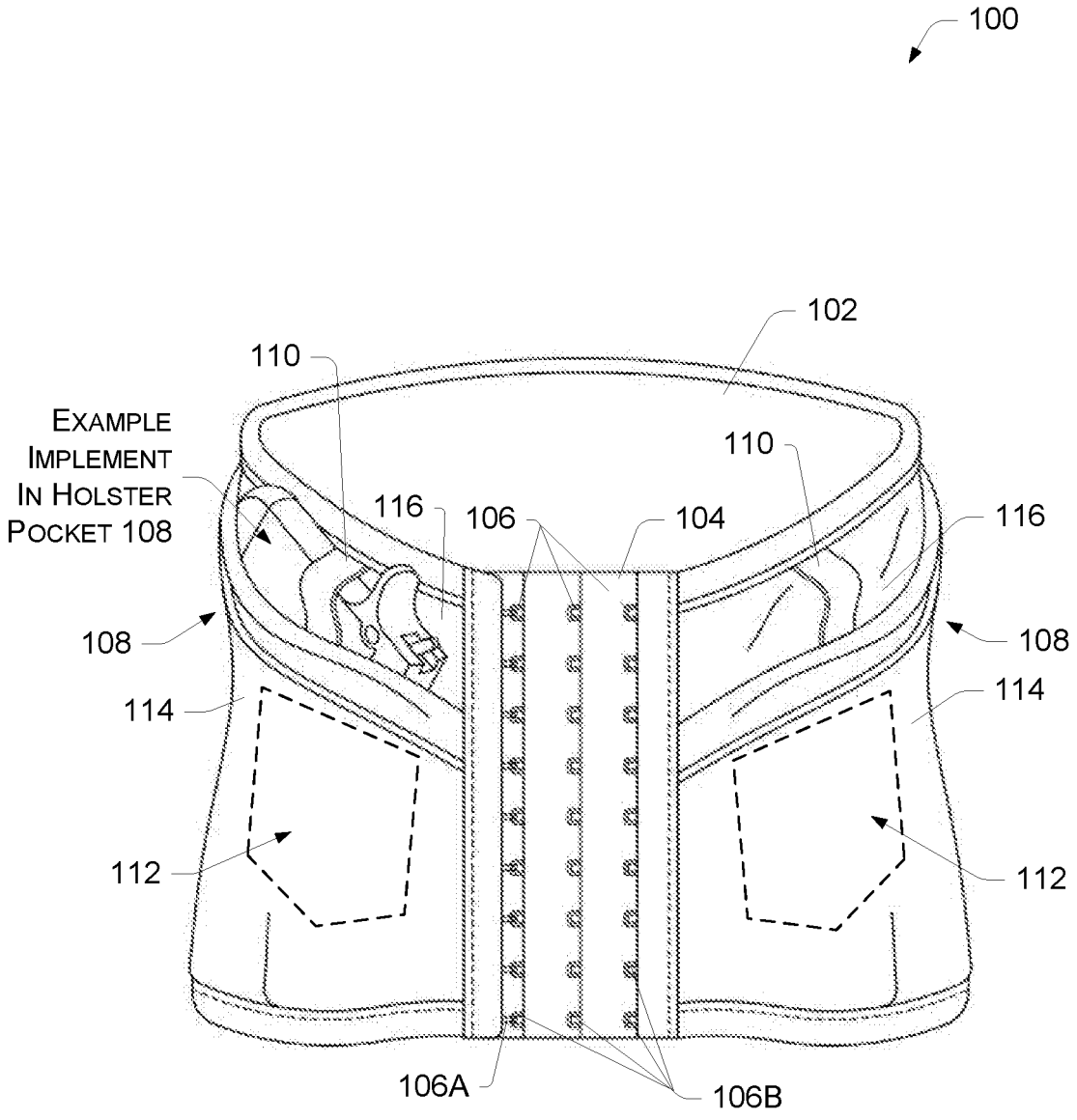
FIG. 1 shows a front view of an example corset holster, with an example implement holstered within a pocket of the corset holster, according to an implementation.

Representative implementations of devices and techniques provide a corset holster comprising a garment having one or more holsters, holster pockets, and/or the like (such as for carrying a handgun, for example), integral to or coupled to the garment. The corset holster allows a user to conveniently carry one or more implements and/or implement accessories in various carry options, including in a concealed manner. For example, the garment may be worn on the user beneath a layer of clothing, if desired.

The corset holster may include one or more protective inserts in one or more configurations to protect the user and the implement, and to prevent the implement (e.g., handgun) from being accidentally accessed or effected through the user's clothing or through the garment. The protective inserts may be comprised of any durable yet pliable material (e.g., thermo-plastic elastomer (TPE), polymers, natural or synthetic leather, natural or synthetic rubber, paper or cardboard with or without natural or synthetic textile fibers or coatings, composites, aramids, combinations of the same, and the like), which will prevent access to the trigger or other operational portion of the implement. The inserts may be formed as a sheet, a pocket, a portion of a pocket, or the like, and may be disposed within layers of the garment, or on an outer surface of a portion of the garment, for example, as a layer of the garment.

Techniques and devices are discussed with reference to example handgun holsters illustrated in the figures. However, this is not intended to be limiting, and is for ease of discussion and illustrative convenience. The techniques and devices discussed may be applied to a holster or to any of various cases, carriers, or containers for implements, tools, accessories, objects, and the like, and remain within the scope of the disclosure.

Further, the size, shape, and quantity of the corset holster and its components illustrated in the figures (including the pockets, fasteners, inserts, retention mechanisms, etc.) may vary to accommodate the various objects to be carried, as well as to accommodate various applications. In alternate embodiments, fewer, additional, or alternate components may be used and/or combined to form a corset holster having an equivalent function and operation.

Implementations are explained in more detail below using a plurality of examples. Although various implementations and examples are discussed here and below, further implementations and examples may be possible by combining the features and elements of individual implementations and examples.

Example Corset Holster

Referring to FIGS. 1-4, an example corset holster 100 is shown in an example embodiment. The corset holster 100 comprises a corset garment, which is worn around a trunk or torso of a user, which includes the waist. In various applications, the corset holster 100 may include portions that are worn around the shoulders, chest, hips, or other portions of a user.

In the various applications, at least a portion (i.e., the corset body portion 102) of the corset holster 100 is worn snugly around a user's trunk, so as to conform to the user's body. This allows a user to wear additional clothing over the corset holster 100, concealing the corset holster 100 and any holstered implements from view, while maintaining a natural appearance.

Figure 2:
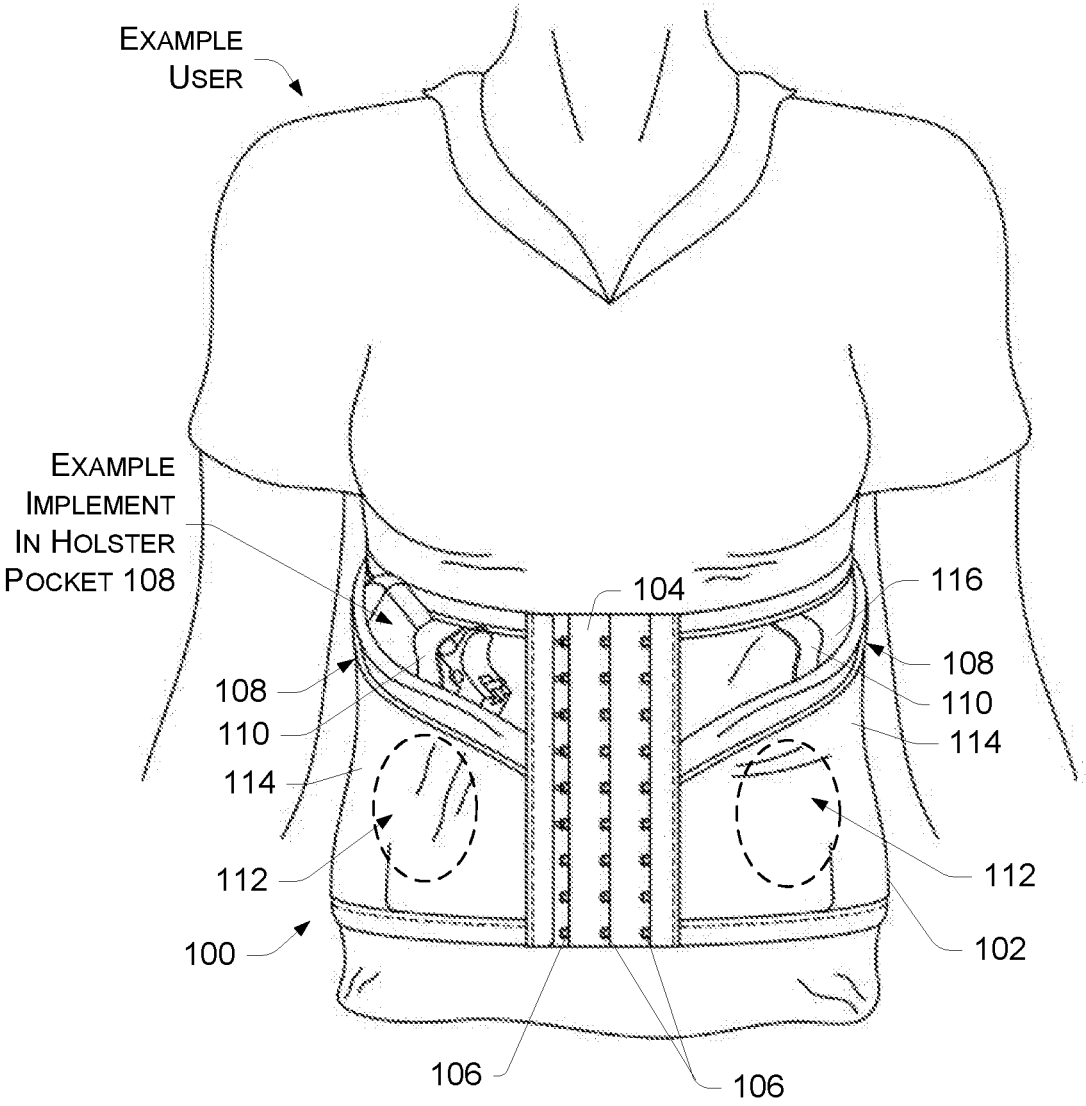
FIG. 2 shows a front view of an example application of the corset holster of FIG. 1, according to an embodiment.

Referring to FIGS. 1 and 2, in various implementations, a corset holster 100 comprises a tube-like corset body portion 102 that makes up the garment base. For example, in the implementations, the body portion 102 comprises a substantially fitted corset garment, comprising a shaped tube or band of materials formed as an irregular cylinder, made of a comfortable but strong material and intended to fit snugly on the user's mid-body. For instance, the shape of the corset body portion ("body portion") 102 generally conforms to the shape of the user's trunk.

The body portion 102 may be constructed from multiple stacked layers of material coupled together (e.g., sewn, glued, etc.), and may include softer material on inside layers and stronger material on the outside layers. Additional material may be added at the borders of the material layers (or the borders of the body portion 102, such as the top and bottom openings, for instance) for added comfort to the wearer.

In some cases, stiffening elements (not shown) such as rigid or semi-rigid components (e.g., plastics, fibers, etc.) may be inserted within the body portion 102 to make the body portion 102 more rigid. The stiffening elements may be inserted within layers of material of the body portion 102, may be glued in, sewn in, or otherwise coupled into the body portion 102, within the layers of material or on the outside or inside surface of one of the layers of material. In some cases, the stiffening elements may be formed with contours intended to conform to the shape of the user's body.

In an implementation, as shown at FIGS. 1-4, the corset holster 100 includes at least one closure portion 104, comprising a reclosable separation in the tube-shaped body portion 102, which allows the body portion 102 to be opened or separated in the front (as shown in the illustrations) and/or in the back, and/or on one or both sides, etc. The closure portion 104 allows the body portion 102 to be opened for putting the corset holster 100 on, and then fastened closed on the user.

Figure 3:
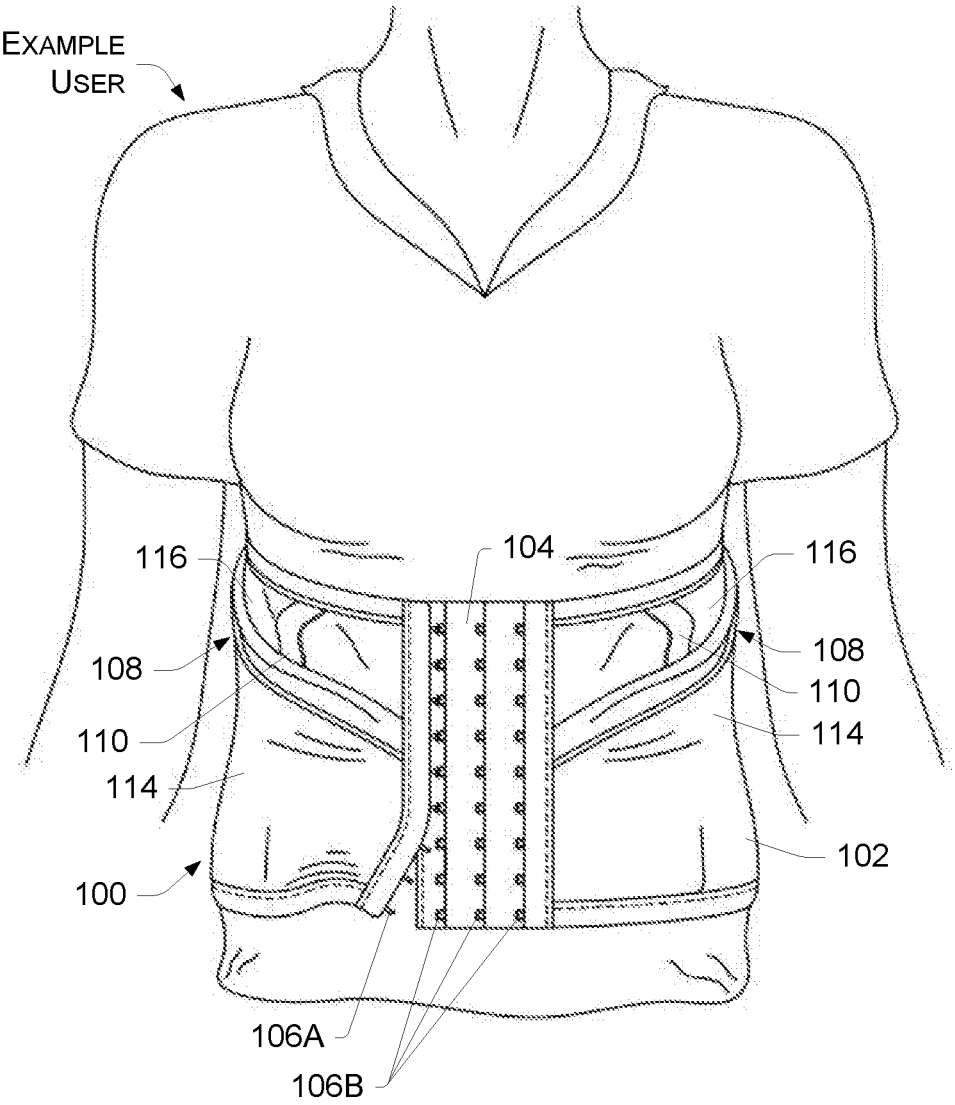
FIG. 3 shows a front view of an example corset holster, with a partly open closure portion, according to an embodiment.

Accordingly, as shown at FIG. 3, the user can open or unfasten the closure portion 104 to allow access into the body portion 102 for putting the corset holster 100 on the user's body. FIG. 3 shows the closure portion 104 partly open. In various embodiments, the closure portion 104 can be fully opened, separating the tube-shape of the body portion 102 into an open band or strip. The closure portion 104 can be closed or fastened to secure the corset holster 100 to the user's body, for example.

The corset holster 100 can include one or multiple closure portions 104, including on the front, side(s), and/or the back of the body portion 102. Each closure portion 104 includes one or more fasteners 106, or the like. In various embodiments, the fasteners 106 may include one or more of hook and loop materials, snaps, buttons, toggles, zippers, hooks, and so forth.

As shown in FIGS. 1-3, in some implementations, the closure portion may include multiple fasteners 106, multiple rows of fasteners 106, or multiple fastener 106 positions, for adjusting the fit of the corset holster 100 to the user. For instance, the user may select from the multiple fasteners 106 or rows of fasteners 106 for desired comfort and utility.

As shown at FIG. 3, a first fastener portion 106A of the fasteners 106 may be attached to a first side of the opening of the closure portion 104 and a second fastener portion 106B of the fasteners 106 may be attached to a second side of the opening of the closure portion 104. Engaging the first fastener portion 106A of the fasteners 106 to a selected one or more of the second fastener portion 106B of the fasteners 106 closes the closure portion 104 and secures the corset holster 100 to the user. Accordingly, in some examples (as shown in FIG. 3) there may be an unequal quantity of first fastener portions 106A relative to second fastener portions 106B to allow for user adjustment of the corset holster 100.

In some embodiments, flexible or stretchable sections (using elastic, spandex, natural or synthetic rubber, or other stretchable materials) may be substituted for one or more of the closure portions 104 or added between portions or panels of the body portion 102. In an alternate embodiment, the corset holster 100 can also be designed to be a waist cincher, which may also use the elastic properties of the garment fabrics and/or stretchable sections to tighten the body portion 102 onto the waist of the wearer.

Figure 4:
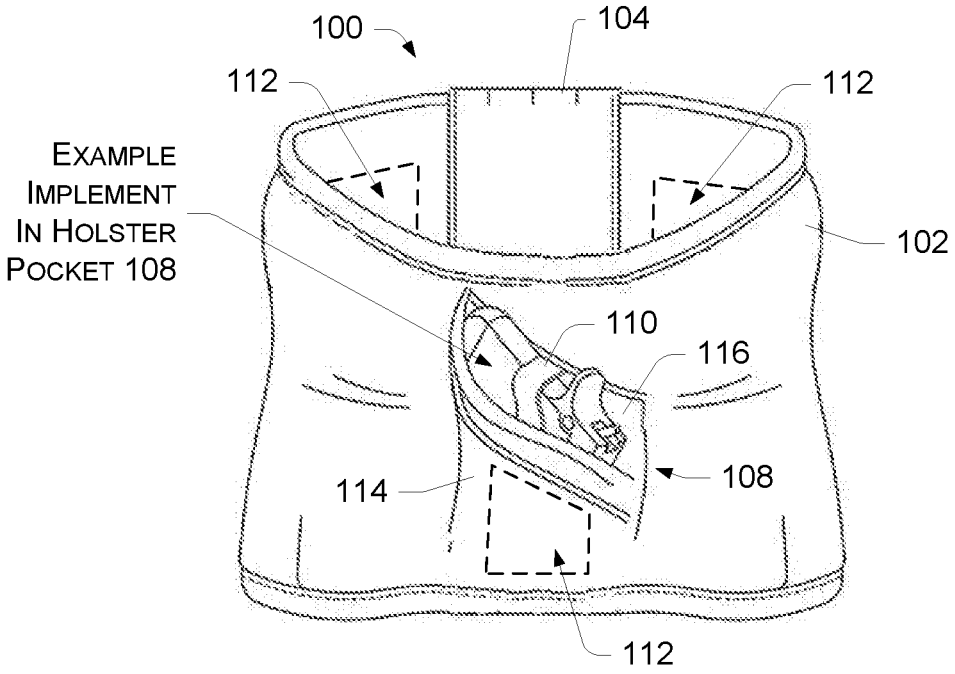
FIG. 4 shows a back view of an example corset holster, according to an embodiment.

In various implementations, as shown at FIGS. 1-4, the corset holster 100 includes one or more holster pockets 108, which may be integral to the body portion 102 or coupled to the body portion 102. Holster pockets 108 comprise pockets designed to receive, encase, and to safely retain an implement, such as a handgun, allowing access to the implement by the user when desired. Holster pockets 108 safely retain the implement when the implement is not in use, protecting the implement and protecting the user from the implement. In various embodiments, holster pockets 108 may also comprise pockets for magazines, accessories, cell phones, and so forth. FIGS. 1, 2, and 4 show an example implement holstered within a holster pocket 108, and FIG. 3 shows a corset holster 100 with empty holster pockets 108.

Referring to FIGS. 1-3, the example corset holster 100 illustrated shows at least two holster pockets on a front of the body portion 102, but that is not intended to be limiting. A corset holster 100 with one holster pocket 108, or with more than two holster pockets 108 on a front of the body portion 102 is also within the scope of the disclosure. For example, a corset holster 100 may include multiple holster pockets 108 on the front, one or both sides, and/or the back of the body portion 102 (see FIG. 4).

Holster pockets 108 may have different sizes and shapes to accommodate various intended implements (e.g., handguns, magazines, knife, wallet, mobile phone, etc.), or for generic use. As shown in the figures, one or more of the holster pockets 108 may be deep enough to nearly or fully enclose an implement stowed in the holster pocket 108.

Holster pockets 108 may be integral to the body portion 102, as shown in FIGS. 1-4, or some holster pockets 108 may be coupled to the inside or outside surface of the body portion 102, as an added enclosure for securing user items and implements. Holster pockets 108 may be open or sealable using one or more fasteners (e.g., hook and loop, zipper, snaps, buttons, etc.).

In some embodiments, the inside surfaces of a holster pocket 108 may include a grippy fabric (silicone or rubber infused fabric, or the like), to increase the retention within the holster pocket 108. For instance, an inside surface of an outer cover 114 and/or an outside surface of an inner cover 116 of a holster pocket 108 may be comprised of the grippy fabric or include a portion of a grippy fabric. In other embodiments, the inside surfaces of one or more of the holster pockets 108 may be comprised of or lined with other materials (aramids, nylon, polymers, natural or synthetic leather, natural or synthetic rubber, etc.) to provide additional durability to these areas, which can receive additional wear.

As shown in FIGS. 2 and 3, the corset holster 100 is worn close to the user's body, making little or no imprint when worn underneath clothing for concealed carry. The location of the holster pockets 108 on the corset holster 100 allow for easy access to the implement when needed. Withdrawing and re-holstering can be accomplished quickly and easily due to the size and position of the holster pockets 108. As shown at FIG. 4, one or more holster pockets 108 may be located at the back of the corset holster 100, also within easy reach.

In various embodiments, the corset holster 100 includes retention devices 110, such as loops, straps, hooks, or the like, to secure the holster pockets 108 when an implement (or other item) is holstered within. For instance, a retention strap 110 (as shown) comprising a strip of material (e.g., natural or synthetic textile, natural or synthetic leather, etc.), or the like, may be used to secure the implement within the holster pockets 108.

The retention strap 110 may be wrapped around a portion of the implement and secured to another portion of the corset holster 100, such as within the holster pocket 108, for example. The retention strap 110 may include hook and loop material, snaps, hooks, or other fasteners or combinations of fasteners at one or both ends of the strap 110 to secure the strap 110 when in use or when not in use.

In alternate implementations, the corset holster 100 may include additional loops, straps, hooks, clips, or the like, to attach one or more accessories to the garment. For instance, a loop or clip, etc. may be disposed within a pocket to secure a key, for example. In another example, a loop or clip, etc. may be attached to an outer surface or edge of the body portion 102 to attach an ID card, badge, penlight, or other accessory.

In various implementations, the body portion 102 of the corset holster 110 may be comprised of soft and comfortable yet durable materials, such as silk, nylon, spandex, and the like. In some embodiments, one or more of the holster pockets 108 are also comprised of these materials. The body portion 102 and the holster pockets 108 may be comprised of multiple stacked layers of materials, for strength and comfort.

The use of soft materials makes for comfortable wear, but in some cases, left on their own they may compromise the safety of the user. For instance, in an example where the implement is a handgun, it may be possible for the trigger of the handgun to be engaged through the materials of the body portion 102, due to the low-density characteristics of some softer materials. Foreign objects that come into contact with the corset holster 100 could also engage the trigger of the handgun and cause the handgun to fire accidentally while still in the holster pocket 108.

In various implementations, one or more protective layers 112 may be used to protect the user and the implement, making the corset holster 100 safe for use with an implement such as a handgun. One or more protective layers 112 may be disposed between material layers of the body portion 102 and/or between material layers of the holster pockets 108, for example. The protective layers 112 can be used at one or more holster pocket 108 locations, overlaying an area of at least part of a holster pocket 108, to reinforce the areas of the holster pockets 108 and around the holster pockets 108. For example, the protective layers 112 can comprise sections of rigid or semi-rigid materials that are layered or stacked with the multiple stacked layers of materials of the body portion 102 and/or the holster pockets 108 to reinforce desired areas of the corset holster 100.

In one embodiment, the protective layer 112 can be permanently coupled to a portion of a holster pocket 108. For instance, the protective layer 112 may be sandwiched or stacked between layers of the outer cover 114 or inner cover 116 of the pocket 108, and sewed and/or glued with the other layers of the multiple stacked layers. In another arrangement, the protective layer 112 can be sewed and/or glued to a surface of the outer cover 114 or inner cover 116 of the pocket 108.

In another embodiment, the protective layer 112 can be removably coupled to a portion of a holster pocket 108. For instance, a protective layer 112 and an outer cover 114 and/or an inner cover 116 of a holster pocket 108 can each include a removable fastener, such as hook and loop, a snap, a button, or the like. The protective layer 112 can be removably coupled to the outer cover 114 or the inner cover 116 of the holster pocket 108 via the removable fastener. In one example, one or more additional holster pockets 108 can also include the removable fastener. In the example, the protective layer 112 can be moved from the outer cover 114 or the inner cover 116 of one holster pocket 108 and removably coupled to one or more of the additional holster pockets that have the removable fastener. The protective layer 112 is coupled to the new pocket 108 via the removable fastener.

In the implementations, a protective layer 112 comprises a section of a durable fabric or material (such as a thermoplastic elastomer (TPE), a polymer, a natural or synthetic leather, a natural or synthetic rubber, paper or cardboard with or without natural or synthetic textile fibers and/or with or without coatings, a composite, an aramid, combinations of these materials, and the like). A protective layer 112 may have a perimeter shape comprising an ellipse, a polygon, an irregular shape, or any other shape as desired. In an example, a protective layer 112 has a perimeter shape that matches an associated portion of the corset holster 100 (e.g., a shape of a holster pocket 108, etc.).

A protective layer 112 should be thin, yet stiff enough to protect the trigger of a firearm from being engaged through the layers of materials of the corset holster 100, and still supple enough to be pliable and bendable, to somewhat conform to the firearm and also to the user's body. If the material is stiff enough that it does not fully conform to the firearm, the protective layer 112 can also aid in preventing an imprint of the firearm on the outside of the user's clothing, assisting in a concealed carry. In various embodiments, the material of the protective layer 112 has a hardness of 50 to 100, Shore durometer, type A. For instance, the material of the protective layer may be a TPE with a hardness of 60, Shore durometer, type A.

The presence of the protective layer 112 can make it safer to carry an implement within the holster pockets 108 by providing a more rigid cover over the implement (and particularly the trigger area of a handgun). This makes the possibility of a negligent discharge highly unlikely to virtually impossible, since the trigger area cannot be accessed or effected through the outer and/or inner covers of the holster pocket, due to the stiffness of the protective layer 112.

As described above, various portions or panels of the corset holster 100, such as all or particular areas of the body portion 102 and/or the holster pockets 108 may be comprised of multiple layers of materials. For instance, the various portions or panels of the corset holster 100 may include: an outer cover 114 of a holster pocket 108, an inner cover 116 of a holster pocket 108, and other areas of the body portion 102, such as the front, sides, and back. Any or all of these areas may be comprised of multiple stacked layers of materials. In some embodiments, the outer cover 114 or the inner cover 116 comprise portions of the body portion 102. For instance, the front of the body portion 102 may comprise the outer cover 114 or the inner cover 116 of one or more front holster pockets 108. Alternately or additionally, the back of the body portion 102 may comprise the outer cover 114 or the inner cover 116 of one or more back holster pockets 108.

Figure 5:
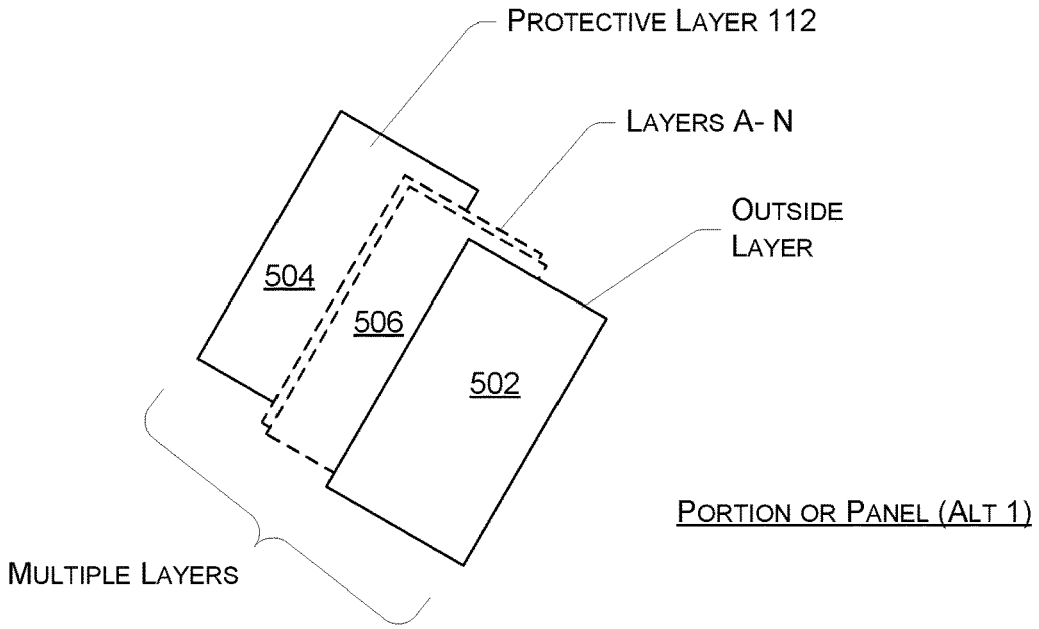
FIG. 5 shows an example of a section of a corset holster, comprising multiple layers, according to an embodiment.
Figure 6:
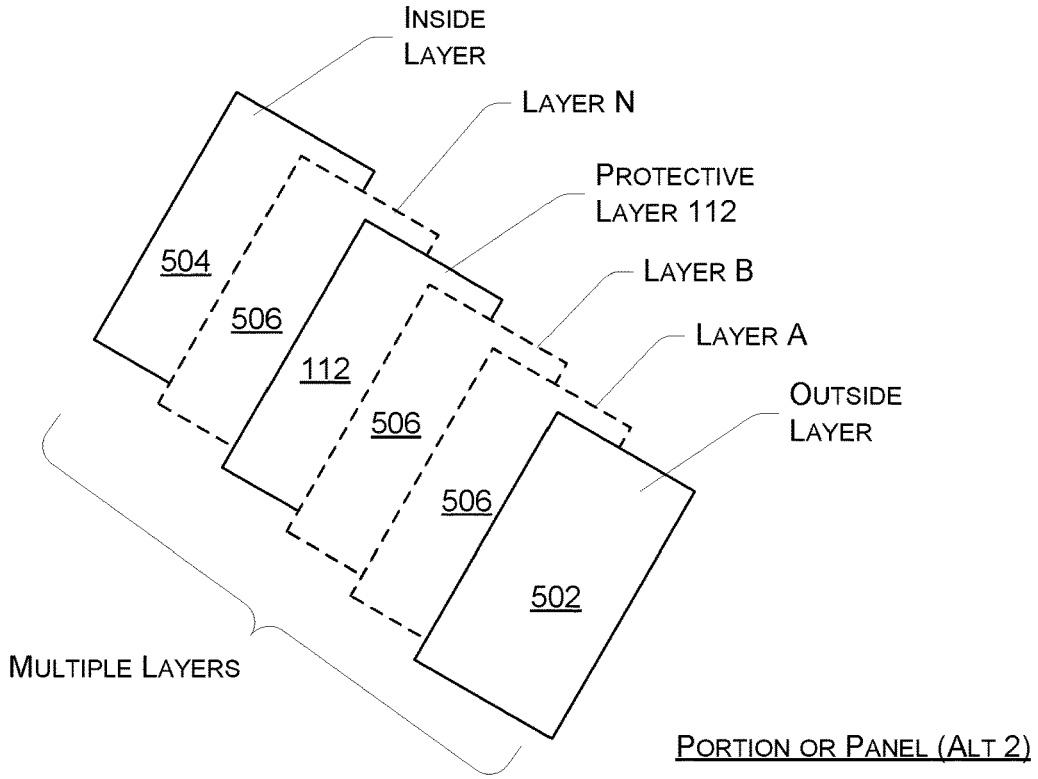
FIG. 6 shows another example of a section of a corset holster, comprising multiple layers, according to an embodiment.

Referring to FIGS. 5 and 6, the multiple stacked layers of materials can include an outside layer 502 of a first fabric or material (such as silk, nylon, spandex, etc.) and an inside layer 504 of a second fabric or material, which may be the same or different from the first fabric or material.

For clarity, an outside layer 502 comprises a layer of the multiple layers of materials that is farthest away from the user when the corset holster 100 is worn by the user. For example, an outside layer 502 may be exposed to the implement when the multiple layers of materials is part of an inner cover 116 of a holster pocket 108, or exposed to the outside environment when the multiple layers of materials is part of an outer cover 114 of a holster pocket 108 or part of the body portion 102.

An inside layer 504 comprises a layer of the multiple layers of materials that is nearest the user when the corset holster 100 is worn by the user. For example, an inside layer 504 may be exposed to the implement when the multiple layers of materials is part of an outer cover 114 of a holster pocket 108, or exposed to the body of the user when the multiple layers of materials is part of an inner cover 114 of a holster pocket 108 or part of the body portion 102.

In one example (shown as alternative 1 at FIG. 5), a portion or panel of the corset holster 100 may be comprised of multiple stacked layers, including an outside layer 502 of a first fabric or material (such as silk, nylon, spandex, etc.) with the protective layer 112 taking the position of the inside layer 504. As shown at FIG. 5, one or more optional additional layers 506 (A-N) of materials may also be present and sandwiched between the outside layer 502 and the inside layer 504. In various examples, the additional layers 506 (A-N) may be comprised of the same or different materials as the outside layer 502 and/or the inside layer 504. In some examples, the one or more additional layers 506 (A-N) may include a moisture barrier, a moisture wicking material, an aramid textile, a composite, or other desired material or combination of material layers.

In another example (shown as alternative 2 at FIG. 6), the multiple stacked layers include an outside layer 502, an inside layer 504, and a protective layer 112 sandwiched between the outside layer 502 and the inside layer 504. As shown at FIG. 6, one or more optional additional layers 506 (A, B-N) of materials may also be present and sandwiched between the outside layer 502 and the protective layer 112 and/or the protective layer 112 and the inside layer 504. In various examples, the additional layers 506 (A, B-N) may be comprised of the same or different materials as the outside layer 502 and/or the inside layer 504. In some examples, the one or more additional layers 506 (A, B-N) may include a moisture barrier, a moisture wicking material, an aramid textile, a composite, or other desired material or combination of material layers. In an alternate embodiment, one or more of the additional layers 506 (A, B-N) may be comprised of an additional protective layer, having the same or a different material composition as the protective layer 112.

For example, referring to FIGS. 5 and 6, a multi-layer portion or panel, such as for the outer cover 114 of a holster pocket 108 or part of the body portion 102 may include various combinations of materials, such as: fabric (silk, nylon, spandex, etc.)-TPE-fabric, fabric-foam-TPE, fabric-TPE-neoprene-fabric, fabric-TPE-foam-neoprene-fabric, and so forth. Any of various optional additional layers 506 (layers A, B N) can be inserted in these and other combinations. Essentially, the outer cover 114 could be constructed of many different materials and layer combinations, as long as the combination includes a protective layer 112 to protect the trigger area of the implement.

In another example, a multi-layer portion or panel, such as for the inner cover 116 of a holster pocket 108 or part of the body portion 102 may include various combinations of materials, such as: fabric (silk, nylon, spandex, etc.)-fabric, fabric-foam-fabric, fabric-elastic, fabric-TPE-foam-fabric, and so forth. Any of various optional layers (layers A, B N) can be inserted in these and other combinations as well.

In an alternate embodiment (not shown), the protective layer 112 may be permanently or removably coupled onto the outside layer 502 or the inside layer 504 of the multi-layer portion or panel, Where the outside layer 502 and the inside layer 504 comprise the same or a different material as the protective layer 112. Further, a protective layer 112 may be used in place of one or both of the outside layer 502 and the inside layer 504.

In various implementations, the multiple stacked layers (alternative 1 or 2) can be sewn together and/or glued together, or the like, to form the multi-layered portions or panels of the corset holster 100.

In one embodiment, the multiple layers (alternative 2) can be sewn together and/or glued together so as to allow the protective layer 112 to be removable from one or more of the portions or panels, and replaceable in the same portion or panel, or replaceable in another portion or panel instead. This way a protective layer 112 may be moved to different locations on the corset holster 100, depending on the implements desired to be carried in the different holster pockets 108.

For instance, in an example, a protective layer 112 may be moved from the outer cover 114 of the right front pocket 108 to the outer cover 114 of the left front pocket 108 to accommodate a left hand draw position instead of a right hand draw position. In another example, a protective layer 112 could be moved to a holster pocket 108 on the back of the corset holster 100, to accommodate a back concealed carry position.

Accordingly, in some embodiments, the multiple layers of materials may be coupled together to allow access between the outside 502 and inside 504 layers at the outer cover 114 and/or the inner cover 116 of the holster pockets 108, and/or at other locations (e.g., portions or panels) on the corset holster 100. For instance, the outside layer 502 of the multiple layers may be permanently coupled (e.g., sewed, glued, etc.) to the inside layer 504 on some edges of a portion or panel, for example, with at least one edge left open to allow access to space between the layers 502 and 504. The at least one open edge allows a user to insert a protective layer 112 into the space between the outside layer 502 and the inside layer 504. Thus, a protective layer 112 can be moved to different locations on the corset holster 100 or removed from some locations as desired. The "open" edge of the multiple layers may be temporarily closed using hook and loop fastener, snaps, zippers, or other temporary fasteners.

Alternately, a protective layer 112 may be attached to a surface of a layer of the multiple layers of material using removable fasteners (hook and loop fasteners, snaps, hooks, etc.). For instance, the protective layer 112 can be removably fastened to a surface of the inside layer 504 of a portion or panel (such as the outer cover 114 of a pocket 108), and moved to another portion or panel by attaching it to the new location in like manner.

In another alternate embodiment, a protective layer 112 may comprise a "pocket liner," having a shape of part of all of the inside of a holster pocket 108. The protective layer 112 may be contoured to fit within a holster pocket 108, taking the shape of all or part of the inside of the holster pocket 108. For example, the protective layer 112 may include the shape of one or both sides of the inside of the holster pocket 108, and may also include the shape of the bottom of the holster pocket 108.

The protective layer 112 may be permanently attached to the inside of the holster pocket 108, by sewing, gluing, etc., or the protective layer 112 may be removably attached to the inside of the holster pocket 108 (using hook and loop, snaps, etc.), or the protective layer 112 may be placed in the pocket 108 and held in place by friction.

Alternately, most or all of the portions or panels of the corset holster 100 (e.g., front, back, sides) may be comprised of multiple stacked layers of materials with a protective layer 112 between the inside layer 504 and the outside layer 502, or attached to the inside 504 or outside 502 layers. In various examples, each of the protective layers 112 may be comprised of the same materials, or of different materials, based on the placement of the protective layer 112 within the corset holster 100. Further, a density of the different protective layers 112 located throughout the corset holster 100 may differ, depending on the location of the protective layer 112 and the desired flexibility of the protective layer 112 at the location.

In various embodiments, as shown at FIGS. 5 and 6, the multiple layers may include one or more of the optional additional layers 506 (layers A, B, N) that can include padding, fill, or foam layers (for comfort or protection), stiffening layers (to add body to the portions or panels), textured layers (to create a unique texture to the portions or panels), absorbent layers (to absorb moisture from the wearer's body), gel layers or the like (to cool the user's body), aramid, composite, or the like layers (for protection against weapon attacks), and so forth.

In the various example embodiments illustrated in FIGS. 1-6, the location and position of the holster pockets 108, retention straps 110, closures 104, fasteners 106, and the like are for example. Other locations and positions are contemplated and are within the scope of this disclosure. In various implementations, the corset holster 100 may include fewer, more, or alternate components, and remain within the scope of the disclosure.

Further, the illustrations of FIGS. 1-6 are not intended to be limiting. While a handgun holster is illustrated, various other types of implement holsters, cases, carriers, and the like are also within the scope of the disclosure. Further, the design of the corset holster 100 as well as the design, shape, and configuration of the various portions of the corset holster 100 may vary. Other designs, devices, and techniques are also within the scope of the disclosure.

Various implementations and examples are discussed herein, and further implementations and examples may be possible by combining the features and elements of individual implementations and examples.

In some cases, additional or alternative components, techniques, sequences, or processes may be used to implement the techniques described herein. Further, the components and/or techniques may be arranged and/or combined in various combinations, while resulting in similar or approximately identical results. It is to be understood that a corset holster 100 may be implemented as a stand-alone device or as part of another system (e.g., integrated with other components). In various implementations, additional or alternative components may be used to accomplish the disclosed techniques and arrangements.

Conclusion

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. A holster garment, comprising:

a corset configured to be worn on a trunk of a user, the corset comprising a substantially tube-shaped fitted garment;

a holster pocket integral to the corset and disposed at a front of the corset, the holster pocket includes an outer cover and an inner cover, which combined are configured to encase and to retain an implement; and a protective layer removably coupled at one or both of the outer cover and the inner cover of the holster pocket, the protective layer comprised of a rigid material and arranged to overlay an area of at least part of the holster pocket, wherein the protective layer and the outer cover or the inner cover of the holster pocket include a removable fastener, and wherein the protective layer is removably coupled to the outer cover or the inner cover of the holster pocket via the removable fastener.

2. The holster garment of claim 1, further comprising one or more additional holster pockets integral to the corset and disposed at a front of the corset.

3. The holster garment of claim 2, further comprising an additional protective layer coupled at one or both of an outer cover and an inner cover of one or more of the additional holster pockets, the additional protective layer comprised of a rigid material and arranged to overlay an area of at least part of the one or more of the additional holster pockets.

4. The holster garment of claim 2, wherein the one or more additional holster pockets also includes the removable fastener, wherein the protective layer is configured to be moved from the outer cover or the inner cover of the holster pocket and removably coupled to the one or more additional holster pockets via the removable fastener.

5. The holster garment of claim 1, further comprising another holster pocket disposed at a back of the corset garment, the other holster pocket including an outer cover and an inner cover configured to encase and to retain an implement.

6. The holster garment of claim 5, further comprising another protective layer coupled at the outer cover or the inner cover of the other holster pocket, the other protective layer comprised of a rigid material and arranged to overlay an area of at least part of the other holster pocket.

7. The holster garment of claim 5, wherein the other holster pocket at the back of the corset garment also includes the removable fastener, wherein the protective layer is configured to be moved from the outer cover or the inner cover of the holster pocket and removably coupled to the other holster pocket at the back of the corset garment via the removable fastener.

8. The holster garment of claim 1, wherein the outer cover or the inner cover of the holster pocket is comprised of multiple stacked layers of material, including an outside layer and an inside layer, and wherein the protective layer is sandwiched between the outside layer and the inside layer.

9. The holster garment of claim 8, wherein the outside layer is not coupled to the inside layer on at least one edge of the outer cover or the inner cover of the holster pocket, and wherein the protective layer is removable or may be inserted, through the at least one edge.

10. The holster garment of claim 1, wherein the outer cover or the inner cover of the holster pocket is comprised of multiple stacked layers of material, including an outside layer and an inside layer, and wherein the protective layer comprises the outside layer or the inside layer.

11. The holster garment of claim 1, wherein the implement comprises a firearm or a firearm accessory.

12. The holster garment of claim 1, wherein the material of the protective layer has a hardness of 50 to 100, Shore durometer, type A.

13. A holster system for a firearm, comprising:

a corset configured to be worn on a trunk of a user, the corset comprising a multi-layered substantially tube-shaped fitted garment;

a pair of holster pockets integral to the front of the corset, at least one of the holster pockets includes an outer cover and an inner cover, which combined are configured to encase and to retain a firearm, the other holster pocket also includes an outer cover and an inner cover, wherein the outer covers and the inner covers of the pair of holster pockets are comprised of multiple stacked layers of material; and a plurality of protective layers removably coupled to the holster pockets with a fastener, each of the protective layers coupled to either an outer cover or an inner cover of one of the holster pockets or sandwiched between stacked layers of material of an outer cover or an inner cover of one of the holster pockets, each of the protective layers comprised of a rigid material and arranged to overlay at least an area of a holster pocket intended to cover a trigger area of a firearm.

14. The holster system of claim 13, further comprising a holster pocket disposed at a back of the corset, and a protective layer permanently or removably coupled to one or both of an outer cover and an inner cover of the holster pocket disposed at the back of the corset.

15. The holster system of claim 13, further comprising a closure portion, comprising a reclosable separation in the tube-shaped fitted garment, the closure portion including a plurality of fasteners.

16. The holster system of claim 13, wherein the outer cover of at least one of the holster pockets includes a first layer of silk, nylon, or spandex, a second layer of thermoplastic elastomer (TPE), and a third layer of neoprene.

17. The holster system of claim 13, wherein the corset is comprised of multiple stacked layers of material including a moisture barrier, a moisture wicking material, an aramid textile, or a composite sandwiched between an outside layer and an inside layer of the multiple stacked layers or comprising one of the outside layer and the inside layer of the multiple stacked layers.

18. A holster system for a firearm, comprising:

a corset configured to be worn on a trunk of a user, the corset comprising a multi-layered substantially tube-shaped fitted garment;

a pair of holster pockets integral to the front of the corset and another pocket at the back or a side of the corset, the pair of holster pockets include an outer cover and an inner cover, which combined are configured to encase and to retain a firearm, the other pocket also includes an outer cover and an inner cover, wherein the outer covers and the inner covers of the pair of holster pockets and the other pocket are comprised of multiple stacked layers of material; and a plurality of protective layers removably coupled to the holster pockets with a fastener, each of the protective layers coupled to either an outer cover or an inner cover of at least one of the holster pockets or sandwiched between stacked layers of material of an outer cover or an inner cover of at least one of the holster pockets, each of the protective layers comprised of a rigid material and arranged to overlay at least an area of a holster pocket intended to cover a trigger area of a firearm.

19. The holster system of claim 18, further comprising one or more retention straps arranged across an opening of at least one of the pair of holster pockets, the one or more retention straps comprising a strip of natural or synthetic textile or natural or synthetic leather configured to be secured to the corset to retain an object within the at least one of the pair of holster pockets.

20. The holster system of claim 18, wherein the protective layers are comprised of thermo-plastic elastomer (TPE), another polymer, a natural or synthetic leather, a natural or synthetic rubber, paper or cardboard with or without natural or synthetic textile fibers or coatings, a composite, an aramid, or a combination of the same.

* * * * *